US005531576A

United States Patent [19]

Kussmann

[11] Patent Number: 5,531,576

[45] Date of Patent: Jul. 2, 1996

[54] WOBBLE PLATE PUMP WITH SIDE CHAMBERS THROUGH WHICH FLUID FLOWS

[75] Inventor: Wolfgang Kussmann, Altrip, Germany

[73] Assignee: KSB Aktiengesellschaft, Frankenthal, Germany

[21] Appl. No.: 393,870

[22] Filed: Feb. 24, 1995

[30] Foreign Application Priority Data

Feb. 24, 1994 [DE] Germany ..... 44 05 945.0

[51] Int. Cl.[6] ..... F04C 2/00

[52] U.S. Cl. ..... 418/53

[58] Field of Search ..... 418/49–53

[56] References Cited

U.S. PATENT DOCUMENTS

| | | | |
|---|---|---|---|
| 1,797,491 | 3/1931 | Ahlberg | 418/53 |
| 1,986,454 | 1/1935 | Wicha | 418/53 |
| 2,691,349 | 10/1954 | Cuny | 418/22 |
| 3,942,384 | 3/1976 | Parker | 418/53 |
| 5,454,699 | 10/1995 | Heng | 418/53 |

FOREIGN PATENT DOCUMENTS

| | | | |
|---|---|---|---|
| 4131628A1 | 9/1991 | Germany . | |
| 717399 | 2/1980 | U.S.S.R. | 418/53 |

*Primary Examiner*—John J. Vrablik
*Attorney, Agent, or Firm*—Darby & Darby

[57] ABSTRACT

This wobble plate pump has a pump chamber and additional chambers, which contain the transport medium. The additional chambers are connected to the suction or compression region of the pump, and the transport fluid flows through these chambers continuously or in a regulated manner. To reduce the technical complication of manufacture and the number of connection points, and also to simplify the exterior cleaning of the pump, the housing has a plurality of integrated channels, through which the additional chambers are fluidly connected to the suction or compression region of the wobble plate pump.

10 Claims, 2 Drawing Sheets

WOBBLE PLATE PUMP WITH SIDE CHAMBERS THROUGH WHICH FLUID FLOWS

BACKGROUND OF THE INVENTION

1. Field of the Invention

The present invention relates to a wobble plate pump having a pair of side chambers through which the pumping fluid flows. The side chamber are in fluid communication with the suction and/or compression chambers of the pump.

2. Description of the Related Art

Wobble plate pumps are known from, for example, DE-A-41 31 628. Besides having a pumping chamber, a first and a second side chamber are, at least partially and at certain times, incorporated into the transport stream. The side chambers are fluidly connected to one another through external pipeline segments. This way of conducting the flow creates flexibility in specifying the flow sequence, but it also creates a large number of connection points, and the technical complications of manufacturing such a system are relatively severe. It is also quite difficult to clean the exterior of this pump. Furthermore, the external pipelines are sensitive to mechanical stresses. However, the basic pump structure and method of operating a wobble plate pump are disclosed in DE-A- 41 31 628, which corresponds to U.S. Pat. No. 5,454,699 and therefore, the disclosures of these references is hereby incorporated by reference.

SUMMARY OF THE INVENTION

It is an object of the present invention to provide a wobble plate pump that includes a pumping chamber and a pair of side chambers that does not require a large number of connection points and the external housing of the pump is easy to clean.

According to a preferred embodiment of the present invention, the housing has integrated channels through which the chambers are connected to the suction or compression region of the pump.

An advantage of the present invention is that the complex external pipe system is reduced to the connections of the pump to the compression and/or suction line and that the required number of parts is reduced. The closed exterior geometry makes it easier to clean the outer surface of the pump. Furthermore, the pump according to the present invention, is easier to transport because, forces associated with mechanical effects, such as impact or falls, are dissipated better.

In a preferred embodiment of the wobble plate pump, the housing includes a middle part, a front part, and a rear part. The front and rear parts have chambers that contain the transport medium, which flows through these chambers and through channels that have been machined into the front and/or rear part.

In a further development of the present invention, the middle part has a connection piece which terminates in a distribution channel. The distribution channel is connected to the integrated channels of the front and/or rear part, and causes the transport stream to be divided. At its inlet opening, the middle part has a preceding collection channel, which merges the divided transport stream and conducts the stream to a pump chamber.

In a further development, the front and/or rear part has at least one connection piece. The middle part itself has no connections, but has a distribution channel and a collection channel which effect the connection between the individual partial streams and through which the fluid flows into the pump chamber.

If the channels which are disposed in the front and/or rear part and which connect the other chambers are disposed at an angle, the resulting advantage is that the intermediate wall can have an arbitrary position. In particular, this makes it easy to dispose the intermediate wall so as to be diametrically opposite the distribution channel.

The design such that the channels are disposed in a plane, i.e. at an angle of 180°, makes it possible for the other chambers to be traversed by fluid symmetrically, and simplifies the manufacture of the respective housing parts.

The front part preferably has a housing cover so that the entire front part need not be removed to make adjustments on the hub of the wobble plate.

The rear part preferably has a pump foot so that a motor can be flanged directly onto the wobble plate pump, thus creating a block unit.

If the front part also has a pump foot, a motor can be disposed on the wobble plate pump. In particular, the variability of the position of the intermediate wall makes it possible to dispose the connection pieces in arbitrary fashion, so that a piggyback arrangement is possible without any difficulty both with respect to the connection piece which terminates in the middle part and with respect to the piece that terminates in the front or rear part.

Parallel sidewalls at the front and/or rear part make the manufacturing process considerably simpler. The wobble plate with the wobble plate hub is a part that is complicated to produce so that the additional processing of its side surfaces in the shape of a conical section has minimal effects.

The wobble plate pump, in accordance with the present invention, is particularly suited for manufacture by casting, since the essential parts of the housing, i.e., the front part, middle part, and rear part, are formed in simple fashion and present no technical difficulties in casting. Efficient mass production is thus possible. In particular, the channels and the connection pieces can be formed directly in integral fashion.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENT INVENTION

Figure 1:
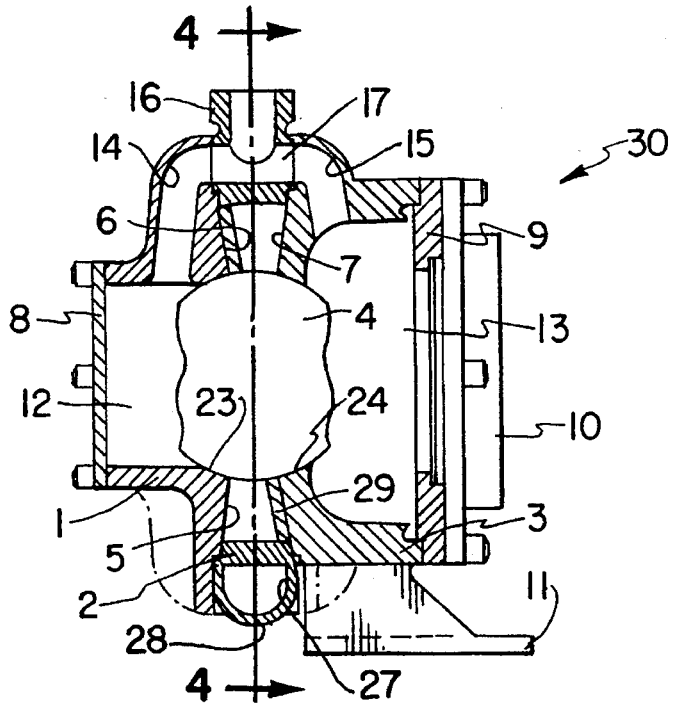
FIG. 1 is a sectional view of a wobble plate pump according to the present invention.

Referring now to FIG. 1, a wobble plate pump 30 is illustrated. Wobble plate pump 30 is comprised of three parts: front part 1, middle part 2, and rear part 3.

Front part 1, middle part 2, and rear part 3 bound or define a pump chamber 5 together with a wobble plate hub 4. The wobble plate 29 has parallel side surfaces and is affixed to the wobble plate hub 4. The wobble plate executes a wobbling motion in pump chamber 5, and thereby moves past the side walls 6, 7, which border the pump chamber 5. The side walls 6 and 7 are partly formed as a conical section.

Front part 1 has a removable housing cover 8. The rear part 3 can be connected to a drive mechanism 10 either directly or through a connection part 9. The rear part 3 also has a pump foot 11 to support the pump housing. The front part 1 has an additional pump foot 11' to support the pump housing.

A front chamber 12 is disposed next to pump chamber 5, between the front part 1 and the wobble plate hub 4. Likewise, a rear chamber 13 is disposed between the wobble plate hub 4 and rear part 3. Front chamber 12 and rear chamber 13 are connected to the pump chamber 5 through gaps (not shown) disposed between the wobble plate hub 4 and the front part 1 on the one hand and between hub 4 and the rear part 3 on the other hand. The transport medium penetrates through these gaps into the front chamber 12 and the rear chamber 13 while the wobble plate pump is operating. To prevent dead spaces, channels 14, 15 are integrally formed in the front part 1 and the rear part 3. These channels 14, 15 are connected to a pipeline system (not shown) through a connection piece 16. The connection piece 16 can be formed on the middle part 2, but can also be disposed on the front or rear part. The middle part 2 has a distribution channel 17, which is in fluid communication with the connection piece 16 and with channels 14 and 15.

Figure 2:
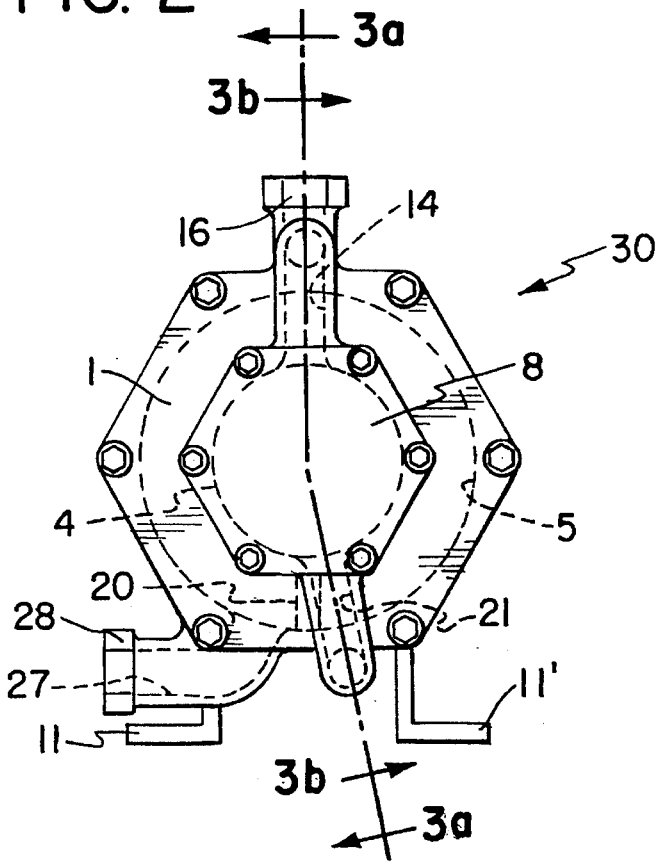
FIG. 2 is a plan view of a wobble plate pump.

FIG. 2 shows a front view of the wobble plate pump. According to the structure and mode of operation of a wobble plate pump, an intermediate wall 20 divides the pump chamber 5 into a suction side region and a compression side region. The transport medium thus enters pump chamber 5 in the immediate vicinity of the outlet of the transport medium from the pump chamber 5. Further integrated channels are present in the front and rear parts 1, 3, to conduct the transport medium from the front chamber 12 and from the rear chamber 13 to the pump chamber.

Figure 3A:
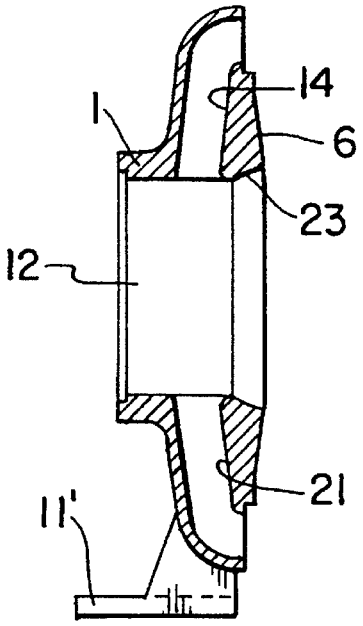
FIG. 3*a* is a sectional view of the wobble plate pump front part, taken along line 3*a*—3*a* of FIG. 2 and looking in the direction of the arrows.
Figure 3B:
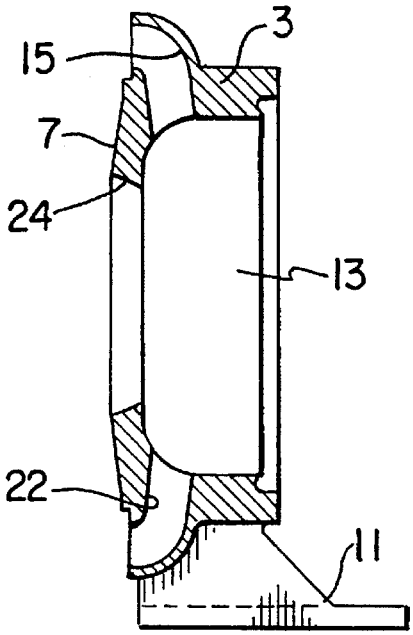
FIG. 3*b* is a sectional view of the wobble plate pump rear part, in a section along lines 3*b*—3*b* of FIG. 2 and looking in the direction of the arrows; and, FIG. 4 is a sectional view of a middle part of the wobble plate pump, taken along the line 4—4 of FIG. 1 and looking in the direction of the arrows.

As illustrated in FIGS. 3*a*, and 3*b*, besides channels 14, 15, which lead to the front chamber 12 and the rear chamber 13 respectively, additional channels 21 and 22 are integrally formed in the front and rear parts 1, 3, respectively, which conduct the transport medium to the inlet of the pump chamber 5. The front part and the rear part have side surfaces 6, 7, which define the pump chamber. Front part 1 and rear part 3 also have a sealing or bearing surface 23, 24 for the wobble plate hub 4.

Figure 4:
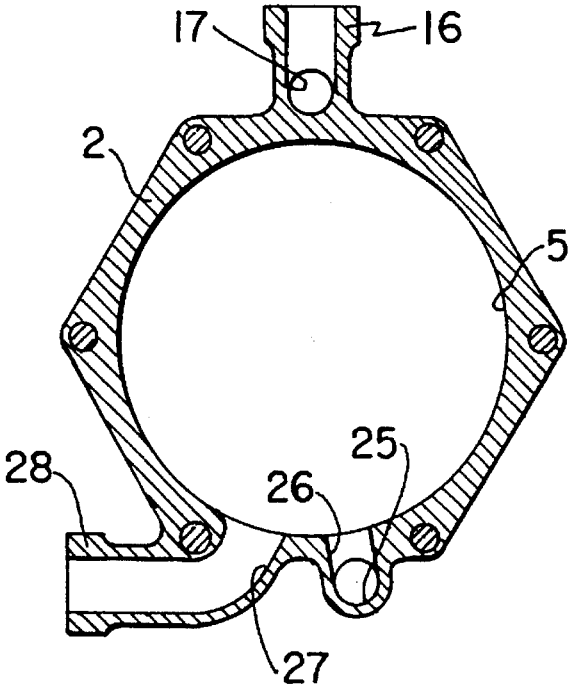

Referring now to FIG. 4, middle part 2 has a connection piece 16, which terminates in the distribution channel 17. A collection channel 25 is disposed at the inlet point of the pump chamber and leads to the entry opening 26 of the pump chamber 5. The exit opening 27 of the pump chamber has a connection piece 28.

The preferred flow of the pumping or transport medium through the wobble plate pump is described below. The transport medium flows through the connection piece 16, which is connected to a suction line, and into the distribution channel 17. The transport stream is divided into two component streams, of which one is conducted through channel 14, to the front intermediate chamber 12, and through channel 21 to the collection channel 25, while the other one is conducted through channel 15 to the rear intermediate chamber 13, and channel 22 to the collection channel 25. All the transport medium now flows from channel 25, through the inlet opening 26, to the pump chamber 5. Through the motion of the wobble plate, the transport medium is brought to the outlet opening 27, where it leaves the pump chamber through the connection piece 28 and flows into the pressure line. If the direction of the rotary drive is reversed the transport medium will flow in the reverse direction, entering connection piece 28 and leaving connection piece 16.

In principle, the position of the intermediate wall 20 can be chosen at will, for example, to bring the connection pieces 16, 28 into a prescribed position with respect to the housing. The channels 14, 15 and 21, 22 can be disposed at an arbitrary angle to one another, and can be made to lie in different planes. A preferred design is to dispose these channels in one plane.

Having described the presently preferred exemplary embodiment of a new and improved a wobble plate pump with side chambers through which fluid flows, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

We claim:

1. A wobble plate pump having a wobble plate hub affixed to a wobble plate, said wobble plate pump comprising:

a housing defining a pump chamber;

a plurality of additional chambers, said additional chambers being defined, at least in part, by the wobble plate hub, said additional chambers being in fluid communication with one of a suction and a compression region of the pump, said additional chambers having means for permitting fluid to flow through said additional chambers, said housing having a plurality of integrated channels which are in fluid communication with said additional chambers and are fluidly connected to said one of the suction and compression region.

2. The wobble plate pump according to claim 1, wherein the housing includes a middle part, a front part and a rear part, said front part being disposed on a side which faces away from a drive of said pump, and said rear part being disposed on a side that faces toward said drive, one of said additional chambers being disposed in said front part and another one of said additional chambers being disposed in said rear part, a plurality of channels being formed in the front part and in the rear part.

3. The wobble plate pump according to claim 2, wherein the middle part includes a connection piece and a distribution channel that is connected to the connection piece, the distribution channel being connected to at least some of the integrated channels, the middle part has a collection channel disposed adjacent to an inlet opening of a pump chamber, the collection channel being connected to the remainder of the integrated channels.

4. The wobble plate pump according to of claim 2, wherein one of the front and rear parts has at least one connection piece, the middle part having a distribution channel disposed between some of the integrated channels and a collection channel disposed between the remainder of the integrated channels.

5. The wobble plate pump according to claim 1, wherein an intermediate wall separates a pump chamber, the integrated channels, which fluidly connect with the front chamber, and the integrated channels, which fluidly connect with the rear chamber are disposed at an angle with respect to one another.

6. The wobble plate pump according to claim 5, wherein the angle is 180°.

7. The wobble plate pump according to claim 1, wherein the front part has a housing cover.

8. The wobble plate pump according to claim 1, wherein the rear part has a pump foot.

9. The wobble plate pump according to claim 8, wherein the front part has an additional pump foot.

10. The wobble plate pump according to claim 1, wherein the front part has a side wall, and the rear part has a side wall, the side walls in part defining a pump chamber and being disposed substantially parallel to one another, and wherein a wobble plate, which executes wobbling motion in the pump chamber, has opposite side surfaces in the form of conical sections.

* * * * *